US005404711A

United States Patent [19]

Rajput

[11] Patent Number: 5,404,711

[45] Date of Patent: Apr. 11, 1995

[54] DUAL FUEL INJECTOR NOZZLE FOR USE WITH A GAS TURBINE ENGINE

[75] Inventor: Amjad P. Rajput, San Diego, Calif.

[73] Assignee: Solar Turbines Incorporated, San Diego, Calif.

[21] Appl. No.: 74,639

[22] Filed: Jun. 10, 1993

[51] Int. Cl.[6] ..... F02C 3/20; F23R 3/36

[52] U.S. Cl. ..... 60/39.463; 60/737; 60/742; 239/400; 239/405

[58] Field of Search ..... 60/39.463, 737, 740, 60/742, 748; 239/400, 405, 406

[56] References Cited

U.S. PATENT DOCUMENTS

| | | | |
|---|---|---|---|
| 3,285,007 | 11/1966 | Carlisle et al. | 60/748 |
| 3,490,230 | 1/1970 | Pillsbury et al. | 60/39.23 |
| 3,691,765 | 9/1972 | Carlisle | 60/742 |
| 3,866,413 | 2/1975 | Sturgess | 60/748 |
| 3,906,718 | 9/1975 | Wood . | |
| 4,327,547 | 5/1982 | Hughes et al. . | |
| 4,337,618 | 7/1982 | Hughes et al. . | |
| 4,342,198 | 8/1982 | Willis | 239/400 |
| 4,463,568 | 8/1984 | Willis et al. . | |
| 4,534,166 | 8/1985 | Kelm et al. | 60/39.23 |
| 4,562,698 | 1/1986 | Halvorsen et al. . | |
| 4,754,600 | 7/1988 | Barbier et al. | 60/39.23 |
| 4,790,480 | 12/1988 | Rennie . | |
| 4,854,127 | 8/1989 | Vinson et al. . | |
| 4,938,417 | 7/1990 | Halvorsen . | |
| 4,948,055 | 8/1990 | Belcher et al. . | |
| 4,999,996 | 3/1991 | Duchene et al. . | |
| 5,062,792 | 11/1991 | Maghon | 239/400 |
| 5,218,824 | 6/1993 | Cederwall et al. | 60/737 |

*Primary Examiner*—Timothy S. Thorpe
*Attorney, Agent, or Firm*—Larry G. Cain

[57] ABSTRACT

Fuel injection nozzles used for reducing NOx in gas turbine engines have incorporated a variety of expensive and complicated techniques. For example, systems use schemes for introducing more air into the primary combustion zone, recirculating cooled exhaust products into the combustion zone and injecting water spray into the combustion zone. The present dual fuel injector reduces the formation of carbon monoxide, unburned hydrocarbons and nitrogen oxides within the combustion zone by providing a series of premixing chambers being in serially aligned relationship one to another. During operation of the dual fuel injector the premixing chambers have a liquid fluid and air or water and air being further mixed with additional air or a gaseous fluid and air. The liquid fluid and the gaseous fluid can be use simultaneously or individually depending on the availability of fluids.

15 Claims, 3 Drawing Sheets

DUAL FUEL INJECTOR NOZZLE FOR USE WITH A GAS TURBINE ENGINE

TECHNICAL FIELD

The present invention relates to a low emission combustion nozzle. More particularly, the invention relates to a dual fuel premix combustor injector nozzle for reducing emissions.

BACKGROUND ART

The use of fossil fuel as the combustible fuel in gas turbine engines results in the combustion products of carbon monoxide, carbon dioxide, water vapor, smoke and particulates, unburned hydrocarbons, nitrogen oxides and sulfur oxides. Of these above products, carbon dioxide and water vapor are considered normal and unobjectionable. In most applications, governmental imposed regulation are further restricting the amount of pollutants being emitted in the exhaust gases.

In the past, the majority of the products of combustion have been controlled by design modifications. For example, at the present time smoke has normally been controlled by design modifications in the combustor, particulates are normally controlled by traps and filters, and sulfur oxides are normally controlled by the selection of fuels being low in total sulfur. This leaves carbon monoxide, unburned hydrocarbons and nitrogen oxides as the emissions of primary concern in the exhaust gases being emitted from the gas turbine engine.

Oxides of nitrogen are produced in two ways in conventional combustion systems. For example, oxides of nitrogen are formed at high temperatures within the combustion zone by the direct combination of atmospheric nitrogen and oxygen and by the presence of organic nitrogen in the fuel. The rates with which nitrogen oxides form depend upon the flame temperature and, consequently, a small reduction in flame temperature can result in a large reduction in the nitrogen oxides.

Past and some present systems providing means for reducing the maximum temperature in the combustion zone of a gas turbine combustor have included water injection. An injector nozzle used with a water injection system is disclosed in U.S. Pat. No. 4,600,151 issued on Jul. 15, 1986, to Jerome R. Bradley. The injector nozzle disclosed includes an annular shroud means operatively associated with a plurality of sleeve means, one inside the other in spaced apart relation. The sleeve means form a liquid fuel-receiving chamber and a water or auxiliary fuel-receiving chamber positioned inside the liquid fuel-receiving chamber. The fuel-receiving chamber is used to discharge water or auxiliary fuel, or in addition, an alternatively to the liquid fuel. The sleeve means further forms an inner air-receiving chamber for receiving and directing compressor discharged air into the fuel spray cone and/or water or auxiliary fuel to mix therewith.

Another fuel injector is disclosed in U.S. Pat. No. 4,327,547 issued May 4, 1982, to Eric Hughes et al. The fuel injector includes means for water injection to reduce NOx emissions, an outer annular gas fuel duct with a venturi section with air purge holes to prevent liquid fuel entering the gas duct. Further included is an inner annular liquid fuel duct having inlets for water and liquid fuel. The inner annular duct terminates in a nozzle, and a central flow passage through which compressed air also flows, terminating in a main diffuser having an inner secondary diffuser. The surfaces of both diffusers are arranged so that their surfaces are washed by the compressed air to reduce or prevent the accretion of carbon to the injector, the diffusers in effect forming a hollow pintle.

The above system and nozzles used therewith are examples of attempts to reduce the emissions of oxides of nitrogen. The nozzles described above fail to efficiently mix the gaseous fluids and or the liquid fluids to control the emissions of oxides of nitrogen emitted from the combustor.

DISCLOSURE OF THE INVENTION

In one aspect of the invention, a dual fuel injector is comprised of a nose piece having a central axis, an annular mixing chamber being radially spaced from the central axis and having an inlet end through which combustion air is introduced and an exit end. A plurality of swirler blades are positioned in the mixing chamber near the inlet end. A means for introducing a gaseous fuel into the mixing chamber is positioned downstream of the plurality of swirler blades. A means for supplying a liquid into the mixing chamber is position downstream of the means for introducing a gaseous fuel into the mixing chamber. The liquid being introduced into the mixing chamber is premixed with combustion air before entering the mixing chamber. A means for introducing a pilot fuel generally along the central axis and being radially inward of the mixing chamber is also included in the dual fuel injector.

The operation of the injector reduces nitrogen oxide, carbon monoxide and unburned hydrocarbon emissions and provides a reliable injection nozzle. The injector, when used with a liquid fuel, premixes the liquid fuel and air in a first mixing chamber or bore, further mixes the mixture of the liquid fuel and air in a second mixing chamber with additional air before entering the combustor. The injector can be used with primarily gaseous fuel only, liquid fuel only or any combination thereof. Furthermore, the injector can be used with water to reduce the flame temperature resulting in reduced emissions. The combination of the mixing chambers results in an efficient homogeneous mixture which maintains gas turbine nitrogen oxide, carbon monoxide and unburned hydrocarbon emissions at a specific low level during operation of the gas turbine engine. When the injector is used to premix a liquid fuel with air, the combination of the mixing chambers results in an efficient homogeneous mixture which maintains gas turbine engine operations at an acceptable level during operation of the gas turbine engine.

BEST MODE FOR CARRYING OUT THE INVENTION

Figure 1:
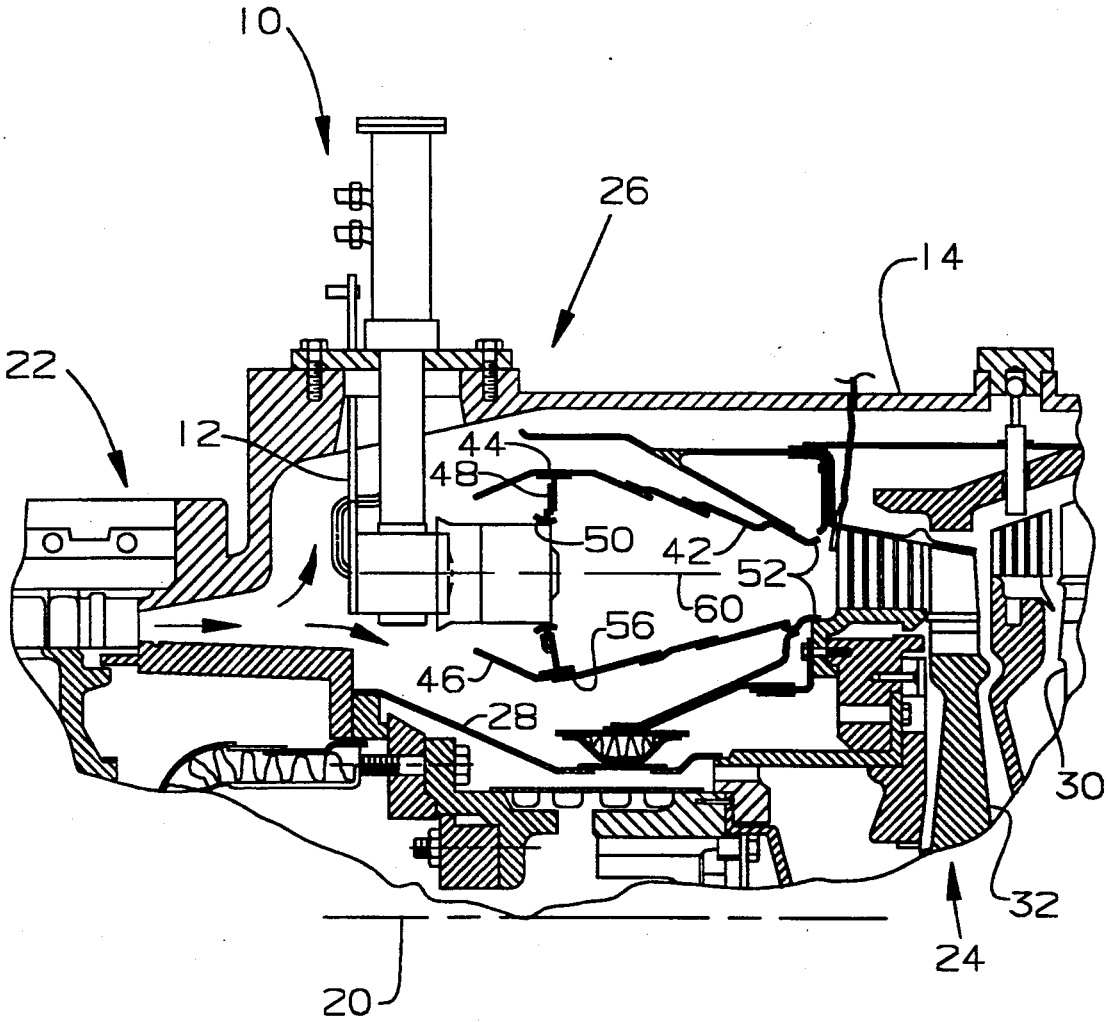
FIG. 1 is a partially sectioned side view of a gas turbine engine having an embodiment of the present invention.
Figure 2:
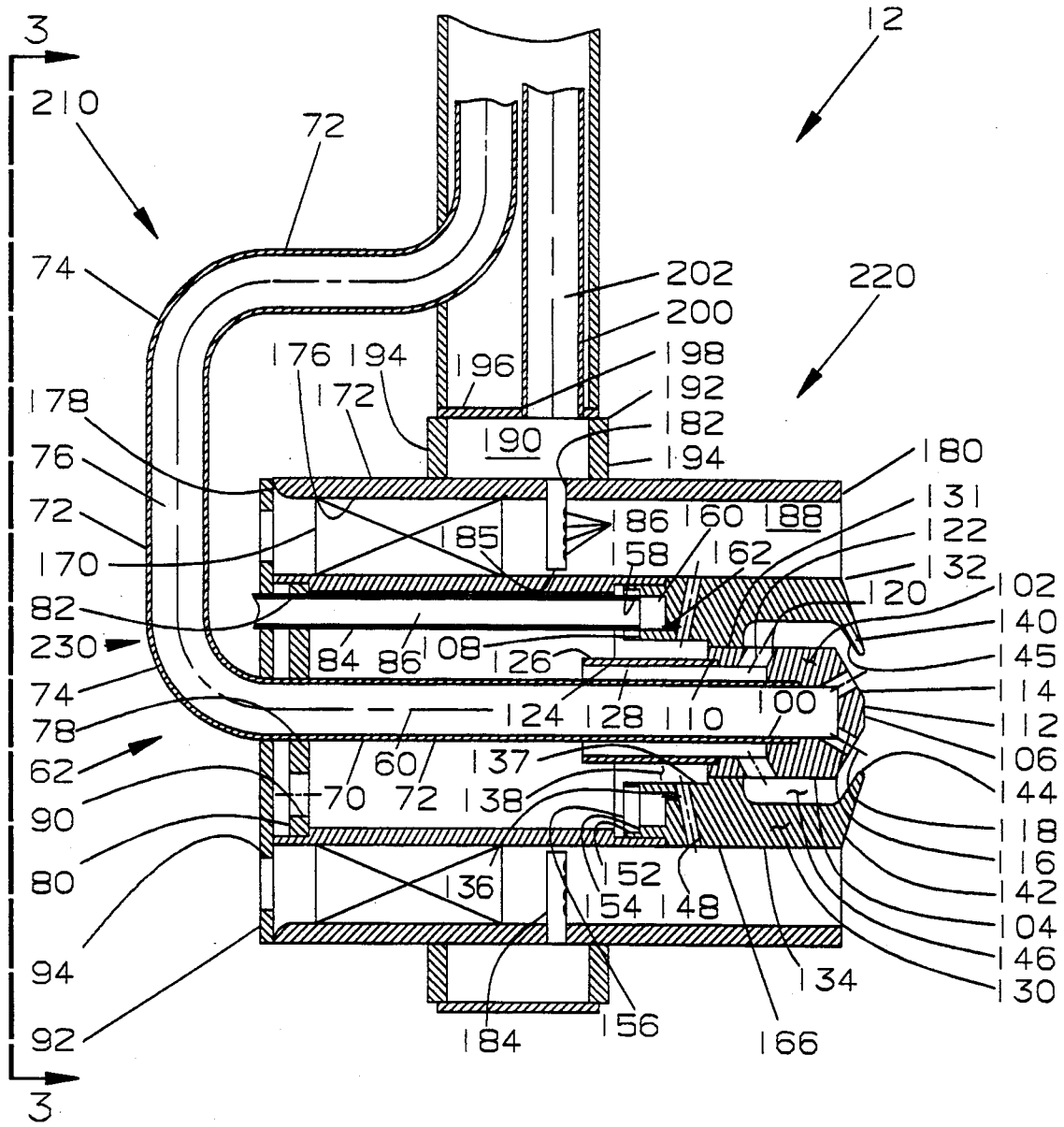
FIG. 2 is an enlarged sectional view of a dual fuel injector used in one embodiment of the present invention.

In reference to FIGS. 1 and 2, a gas turbine engine 10 having a dual fuel (gaseous/liquid) premix injection nozzle 12 for reducing nitrogen oxide, carbon monoxide and unburned hydrocarbon emissions therefrom is shown. The gas turbine engine 10 includes an outer housing 14 having a plurality of openings 16 therein having a preestablished positions and relationship to each other. The injector 12 is of the dual fuel injection type is positioned in the openings 16 and is supported from the housing 14 in a conventional manner. In this application, the housing 14 further includes a central axis 20 and is positioned about a compressor section 22 centered about the axis 20, a turbine section 24 centered about the axis 20 and a combustor section 26 interposed the compressor section 22 and the turbine section 24. The engine 10 has an inner case 28 coaxially aligned about the axis 20 and is disposed radially inwardly of the combustor section 26. The turbine section 24 includes a power turbine 30 having an output shaft, not shown, connected thereto for driving an accessory component such as a generator. Another portion of the turbine section 24 includes a gas producer turbine 32 connected in driving relationship to the compressor section 22. When the engine 10 is operating, a flow of compressed air exits the compressor section 22 and is used to mix with a combustible fuel or as cooling.

The combustor section 26 includes an annular combustor 42 being radially spaced a preestablished distance from the housing 14 and being supported from the housing 14 in a conventional manner. The combustor 42 has an annular outer shell 44 being coaxially positioned about the central axis 20, an annular inner shell 46 being positioned radially inwardly of the outer shell 44 and being coaxially positioned about the central axis 20, an inlet end portion 48 having a plurality of generally evenly spaced openings 50 therein and an outlet end portion 52. Each of the openings 50 has the dual fuel injector 12 having a central axis 60 being generally positioned therein in communication with the inlet end 48 of the combustor 42. As an alternative to the annular combustor 42, a plurality of can type combustors or a side canular combustor could be incorporated without changing the essence of the invention.

As further shown in FIG. 2, each of the injectors 12 includes a means 62 for introducing a pilot fuel generally along the central axis 60 which includes a centrally located pilot fuel tubular member 70 centered about the axis 60. The pilot fuel tubular member 70 has a plurality of straight portions 72 connected by a plurality of generally curved or angled portions 74 each having a passage 76 therein being in fluid communication with a source of pilot fuel. In this application, the pilot fuel is a gaseous combustible material such as natural gas. One of the straight portions 72 sealingly extends through a central aperture 78 in a generally circular end plate 80. The plate 80 further includes a radially spaced aperture 82 in which is sealingly positioned a liquid fuel tubular member 84 having a passage 86 therein being in fluid communication with a source of liquid fuel. Further positioned in the plate 80 is a plurality of passages 90 having a preestablished area.

Figure 3:
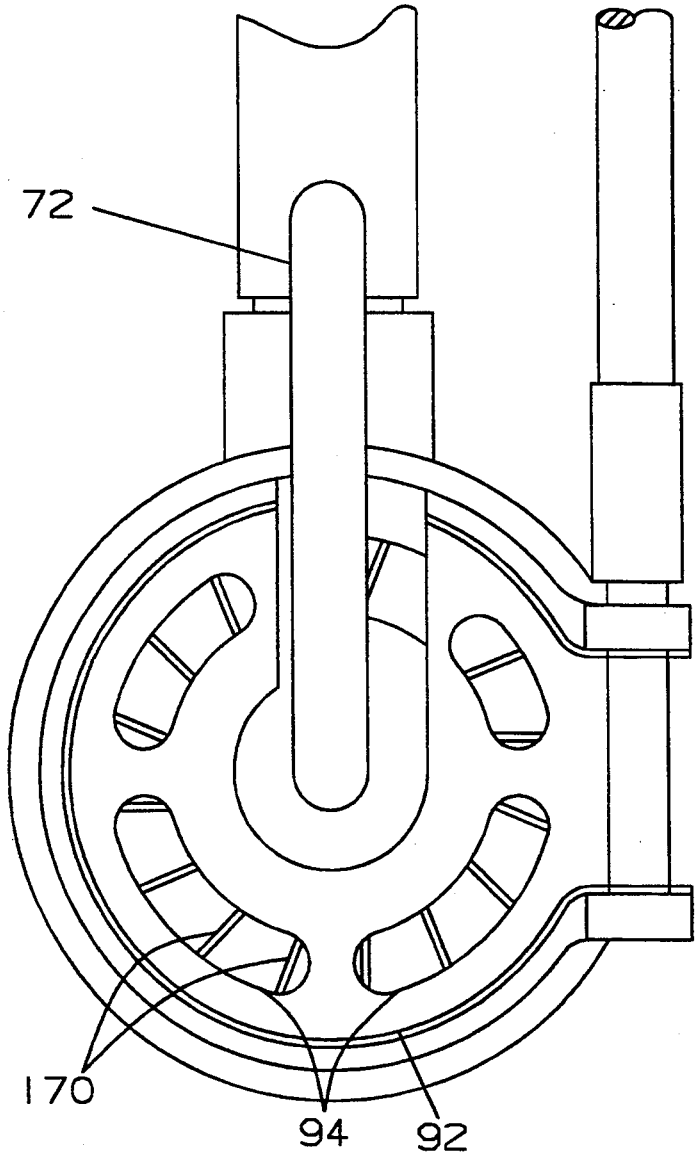
FIG. 3 is a view taken along line 3—3 of FIG. 2.

As shown in FIG. 3, a flapper valve 92 of conventional design is pivotably mounted to the outer housing 14. The flapper valve 92 includes a plurality of slots 94 radially spaced from the axis 60 a predetermined dimension. A nose piece 100 includes a blind bore 102 in which an end of the pilot fuel tubular member 70 is sealingly fixedly attached. The noise piece 100 has a generally cylindrical shape and includes an outer surface 104, an outlet end 106 and an inlet end 108. The blind bore 102 extends from the inlet end 108 and extends short of the outlet end 106. A counter bore 110 being larger in diameter than the blind bore 102 extends from the inlet end 108 and extends short of the end of the blind bore 102. The outlet end 106 includes a flat portion 112 and a tapered portion 114 being at an angle of about 30 degrees to the flat portion 112. The means 62 for introducing a pilot fuel further includes a plurality of passages 116 having an axis 118 extending generally perpendicular to the tapered portion 114 and radially intersecting the axis 60. Each of the plurality of passages 116 intersect with the blind bore 102 and are communicated with the passage 76 in the pilot fuel tubular member 70. Another plurality of passages 120 have an axis 122 extending at an angle of about 60 degrees to the outer surface 104 and radially extends toward the axis 60. Each of the plurality of passages 120 intersects with the counter bore 110. A generally tubular shell member 124 having an outer surface 126 and an inner bore 128 therein is coaxially sealingly attached within the counter bore 110.

A ring member 130 is attached to the outer surface 104 of the noise piece 100 at an inner surface 131. The ring member 130 further includes a combustor end 132 being angled to the axis 60, an outer surface 134 and an inlet end 136 having a counter bore 137 therein forming an annular passage 138 between the counter bore 137 and the shell member 124. A lip portion 140 extends inwardly from the outer surface 134 and has a combustor end surface 142 formed thereon extending between the outer surface 134 and the inner extremity of the ring member 130. The lip portion 140 further includes a tip 144 positioned internally of the outer surface 104. The lip portion 140 has a reflector portion 145 which is spaced from the tapered portion 114 a preestablished distance, which in this application is about 2 mm.

Formed within the ring member 130 and axially extending generally from the reflector portion 145 toward the inlet end 136 along the noise piece 100 is an annular groove 146 which communicates with the space formed between the reflective portion 145 and the tapered portion 114 of the noise piece 100. Furthermore, the annular groove 146 is in communication with the space between the counter bore 110 and the tubular member 70. Further positioned in the ring member 130 is a plurality of through bores 148 extending from the outer surface 134 through the blind bore 137 having a preestablished area which, in this application, has about a 2.3 mm diameter. Each of the bores 148 is angled with respect to the outer surface 104 by approximately 15 degrees and radially extends toward the axis 60 and axially extends away from the outlet end 106. The inlet end 136 of the ring member 130 includes an annular groove 152 having a step 154 therein. A plate 156 is fixedly positioned in the groove 152 and has a bore 158 therein and forms a reservoir 160 within the ring member 130. The liquid fuel tubular member 84 has an end sealingly fixedly attached within the bore 158. A passage 162 interconnects corresponding ones of the plurality of bores 148 with the reservoir 160.

The passage 162 has a preestablished area, which, in this application, has about a 1.0 mm diameter. The ratio of the area of the bore 148 to the area of the passage 162 is about 2 to 1. Extending from the inlet end 136 and attached thereto is a thin walled tube 166 having an outer surface 168 coaxial with the outer surface 134 of the ring member 130. The thin walled tube 166 surrounds the liquid fuel tubular member 84 and the tubular member 70 and has an end attached to the plate 80.

Intermittently spaced about the outer surface 168 of the thin walled tube 166 is a plurality of swirler blades 170 which support a housing member 172. The housing member 172 has an inner surface 174, an outer surface 176, a first end 178 axially extending beyond the plate 80 and a second end 180 positioned axially inward of the flat portion 112 of the noise piece 100 and the combustor end 132 of the ring member 130. Interposed the second end 180 and the plurality of swirler blades 170 is a plurality of bores 182 extending between the inner surface 174 and the outer surface 176. Positioned in each of the plurality of bores 182 is a hollow spoke member 184. A sealed end 185 of each spoke member 184 is spaced from the outer surface 168 of the thin walled tube 166. Axially spaced along each spoke member 184 is a plurality of passages 186 which, in the assembled position, are generally directed toward the second end 180. The space between the outer surface 168 of the thin walled tube 166 and the outer surface 134 of the ring member 130, and the inner surface 174 of the housing member 172 forms an annular gallery or mixing chamber 188 having an inlet end 189 and an exit end 190. An annular gallery 191 is defined by a generally u-shaped member 192 having a pair of legs 194 and a base 196. Positioned in the base 196 is a bore 198 which has a tubular member 200 fixedly attached therein. The passage 202 is in fluid communication with a source of combustible fuel which in this application is a gaseous fuel. The passage 202 is in further communication with the plurality of passages 186 by way of the annular gallery 191 and the hollow portions of the spoke members 184.

As best shown in FIG. 3, the dual fuel injector 12 further includes a means 210 for controlling the amount of combustion air entering the mixing chamber 188 which includes the flapper valve 92. A means 220 for supplying a combustible liquid fuel to the mixing chamber 188 and a means 230 for introducing a combustible gaseous fuel to the mixing chamber 188 are also included in the dual fuel injector 12. The means 220 for supplying combustible liquid fuel to the mixing-chamber 188 includes the liquid fuel tube 84 and the passage 86, the reservoir 160, the passages 162 and the plurality of bores 148. Thus, liquid combustible fuel is communicated through the liquid supply means 220 to the mixing chamber 188. As an alternative, the means 220 for supplying a combustible liquid fuel to the mixing chamber 188 could be used to supply a non-combustible material such as water, if desired. The means 230 for introducing a combustible gaseous fuel to the mixing chamber 188 includes the tubular member 200 and the passage 202, the annular gallery 191, the hollow spoke members 184 and the plurality of passages 186. Thus, gaseous combustible fuel is communicated through the gaseous supply means 230 to the mixing chamber 188. The gaseous fuel and the liquid are each mixed within the mixing chamber 188 and exit through the exit end 190 of the mixing chamber 188.

INDUSTRIAL APPLICABILITY

In use the gas turbine engine 10 is started and allowed to warm up and is used to produce either electrical power, pump gas, turn a mechanical drive unit or another application. As the demand for load or power produced by the generator is increased, the load on the engine 10 is increased. During start up and low engine RPM only pilot fuel, which is normally a gaseous fuel, is used to operate the engine 10. For example, gaseous fuel is introduced through the passage 76 in the pilot fuel tubular member 70. The pilot fuel exits through the plurality of passages 116 in the noise piece 100, while simultaneously air from the compressor section 22 enters through the plurality of passages 90 in the plate 80. The preestablished area of these passages 90 and the position of the flapper valve 92 regulate the quantity of air passing through the space between the counter bore 110 and the tubular member 70, the plurality of passages 120 in the noise piece 100, into the annular gallery 146 and exits through the preestablished space between the tapered portion 114 on the noise piece 100 and the reflector portion 145 of the lip portion 140. The pilot fuel and the air are effectively mixed since the air and the pilot fuel rather violently collide and mix near the flat portion 106 of the noise piece 100. Thus, combustion of the pilot fuel and air start and functionally operate the engine 10 during low engine speed.

As further power is demanded, either additional gaseous fuel or liquid fuel or both are added to increase the power. For example, when using gaseous fuel only, after starting the pilot may remain on or be extinguished, additional gaseous fuel is introduced through the passage 202 and into the annular gallery 191, through the hollow spoke members 184 and exits the plurality of passages 186 entering the mixing chamber 188. Air, after passing through the swirler blades 170, mixes with the fuel from the plurality of passages 186 within the mixing chamber 188 and exits as a homogeneous mixture into the combustor 42. Depending on the functional demands of the engine 10 and preestablished parameters of the engine 10 the quantity of fuel is varied and the flapper valve 92 is used to vary the amount of air entering into the plurality of swirler blades 170 and the mixing chamber 188 for mixing with the fuel. With the flapper valve 172 in the closed position, air to the mixing chamber 188 is reduced to a minimum. As additional power is demanded, additional fuel and air is mixed and burned.

If only liquid fuel is being used as the power demand increases, normally pilot fuel will remain in use. Pilot fuel remains in use to insure that flameout does not occur during sudden changes in power demand. However, the percentage of pilot fuel will normally be reduced to a minimum level. The liquid fuel enters the passage 86 from the external source and flows into the reservoir 160. The liquid fuel exits the reservoir 160 by way of the passages 162 wherein the area of the passage 162 cause the liquid fuel to spray in the form of a mist into the bores 148 and mixes with air coming through the passages 90 and the annular passage 138. The mist generally follows along the bores 148 to exit into the mixing chamber 188 wherein swirling air, the quantity of which is controlled by the flapper valve 92, is mixed therewith to form a generally homogeneous mixture. The combustible mixture of air and liquid fuel enter into the combustor 42 and burns.

If liquid fuel and gaseous fuel are used simultaneously as the power demand increases, the pilot fuel normally will not be used. The description above explaining the structural operation of the liquid and gaseous fuel separately are identical when using a combination of liquid and gaseous fuel. The primary difference occurs in the percentage of total liquid or gaseous fuel to be mixed with the air. For example, if a large percentage of liquid fuel is to be burned in the engine 10 only a small amount of gaseous fuel will be burned in the engine 10. The reciprocal of this holds true if a large percentage of gaseous fuel is to be burned in the engine 10. Any variable of fixed percentage can be functionally burned in the engine 10.

The dual fuel injector 12 provides an injector which is suitable for burning liquid fuel, gaseous fuel or a combination thereof. The structural combination of the swirler blades 170 to swirl the air, the plurality of passages 186 within the spokes 184 to emit gaseous fuel and the mixing chamber 188 provide an injector 12 or nozzle which efficiently mixes the gaseous fluids with air to control the emissions of oxides of nitrogen emitted from the combustor 42. The further addition of the flapper valve 92 to control the quantity of air further controls the emissions of oxides of nitrogen emitted from the combustor 42. Additionally, the structural combination of the swirler blades 170 to swirl the air, the reservoir 160, the passages 162 having a preestablished area, the plurality of bores 148 acting as a premixing chamber and the final mixing chamber 188 provide an injector 12 or nozzle which efficiently mixes the fuels with air to control the emissions of oxides of nitrogen emitted from the combustor 42. The addition of the flapper valve 92 further controls the emissions of oxides of nitrogen emitted from the combustor 42. The structures when combined provide a liquid and/or gaseous fuel injector 12 which controls the emissions of oxides of nitrogen emitted from the combustor 42.

Other aspects, objectives and advantages of this invention can be obtained from a study of the drawings, the disclosure and the appended claims.

I claim:

1. A dual fuel injector, comprising:

a nose piece having a central axis;

a single annular mixing chamber being radially spaced from the central axis and having an inlet end through which combustion air is introduced and an exit end;

a plurality of swirler blades being positioned in the mixing chamber near the inlet end;

means for introducing a gaseous fuel into the mixing chamber being positioned downstream of the plurality of swirler blades;

means for supplying a liquid into the mixing chamber at a position downstream of the means for introducing a gaseous fuel into the mixing chamber, said liquid being introduced into the mixing chamber being premixed with combustion air before entering the mixing chamber; and means for introducing a pilot fuel generally along the central axis and being radially inward of the mixing chamber.

2. The dual fuel injector of claim 1 wherein said premixed liquid and air are further mixed with additional combustion air in the mixing chamber.

3. The dual fuel injector of claim 1 wherein during operation of the injector said means for introducing a gaseous fuel to the mixing chamber includes a plurality of spoke members extending into the mixing chamber and being positioned between the plurality of swirler blades and the exit end of the mixing chamber, each of said plurality of spoke members having a plurality of passages therein being in fluid communication with a source of gaseous fuel.

4. The dual fuel injector of claim 3 wherein said plurality of passages in each of the plurality of spoke members are generally directed toward the exit end of the mixing chamber.

5. The dual fuel injector of claim 1 wherein said means for supplying a liquid into the mixing chamber during operation of the dual fuel injector supplies a combustible fuel into the mixing chamber.

6. The dual fuel injector of claim 5 wherein said means for supplying a liquid into the mixing chamber includes a reservoir having a passage exiting therefrom, said passage having a preestablished area and exiting into a bore being in communication with the mixing chamber.

7. The dual fuel injector of claim 6 wherein said bore has a preestablished area and is in fluid communication with the combustion air.

8. The dual fuel injector of claim 7 wherein said preestablished area of each of the plurality of bores is about twice the preestablished area of the passages.

9. The dual fuel injector of claim 7 wherein said liquid combustible fuel and said compressed air are premixed within a plurality of bores prior to entering the mixing chamber.

10. The dual fuel injector of claim 5 wherein said means for supplying a liquid into the mixing chamber includes a reservoir having a plurality of passages exiting therefrom, said passages having a preestablished area and exiting into a plurality of corresponding bores being in communication with the mixing chamber.

11. The dual fuel injector of claim 1 further including a means for controlling the amount of combustion air entering into the mixing chamber.

12. The dual fuel injector of claim 11 wherein said means for controlling the amount of compressed air entering into the mixing chamber further controls the amount of combustion air entering into the plurality of swirler blades.

13. The dual fuel injector of claim 11 wherein said means for controlling the amount of compressed air entering into the mixing chamber includes a flapper valve.

14. The dual fuel injector of claim 13 wherein said flapper valve includes a plurality of slots aligned with the mixing chamber.

15. The dual fuel injector of claim 1 wherein said gaseous fuel and said liquid each exit the dual fuel injector through the exit end of the mixing chamber.

* * * * *